United States Patent [19]

Jones

[11] Patent Number: 4,936,081

[45] Date of Patent: Jun. 26, 1990

[54] SHOCK ABSORBING STIRRUP

[76] Inventor: David A. Jones, 607 Elmdale Ln., Springdale, Ark. 72764

[21] Appl. No.: 310,312

[22] Filed: Apr. 12, 1989

[51] Int. Cl.[5] ..... B68C 3/00

[52] U.S. Cl. ..... 54/48

[58] Field of Search ..... 54/46, 47, 48

[56] References Cited

U.S. PATENT DOCUMENTS

| | | | |
|---|---|---|---|
| 174,492 | 3/1876 | Crosby | 54/48 X |
| 746,126 | 12/1903 | Myers | 54/48 |
| 1,991,648 | 2/1935 | Armentrout | 54/48 |
| 4,761,938 | 8/1988 | Townsend | 54/47 |

*Primary Examiner*—Robert P. Swiatek

[57] ABSTRACT

There is disclosed a shock absorbing equestrian stirrup including a generally stirrup-shaped rigid structure having a substantially horizontal tread portion with a cushion thereon, two upright side portions joined near their top ends by a support bar and further including a ring of elastomeric energy absorbing material with a diameter somewhat less than the distance between the upright side portions of the stirrup structure, the ring being secured by a bolt in a position just under the support bar. Preferably, the stirrup is provided with a keeper to retain the saddle leathers, or straps, extending down from the saddle in position looped under the elastomeric ring. The keeper takes the form of polypropylene belting looped from the top of the support bar down around the ring and back to the loop of the support bar having on the outside edges thereof lengths of nylon belting secured to form a loop extending horizontally on the outside of the keeper and adapted to receive and retain the saddle leathers or straps as they pass around and under the elastomeric ring. The vertical deflection force characteristic of the elastomeric ring is preferably at least about 200 pounds per inch.

9 Claims, 2 Drawing Sheets

SHOCK ABSORBING STIRRUP

BACKGROUND OF INVENTION

My invention relates to stirrups for saddles which employ an energy or shock absorbing device. Most stirrups are constructed of one piece of aluminum, steel, plastic, or other material and mounted to the stirrup leathers with no shock or energy absorbing devices. Past patents have employed springs as in Patent 706468. Springs do not have the capability to absorb energy. Springs will store energy, giving back the same amount of energy that it receives. My invention will absorb or dispel the energy that is created. Background information was found in Class 54, Sub Class 47.

SUMMARY OF INVENTION

This invention relates to saddle stirrups and the object thereof is to provide an improved device of this class which is particularly designed to help eliminate the shock created when riding horses, but which may be used wherever stirrups of this class are employed.

BRIEF DESCRIPTION OF THE DRAWINGS

The invention is fully disclosed in the following specification of which the accompanying drawings form a part in which the separate parts of my improvements are designated by suitable reference characters in each of the views and in which.

DETAILED DESCRIPTION

Figure 1:
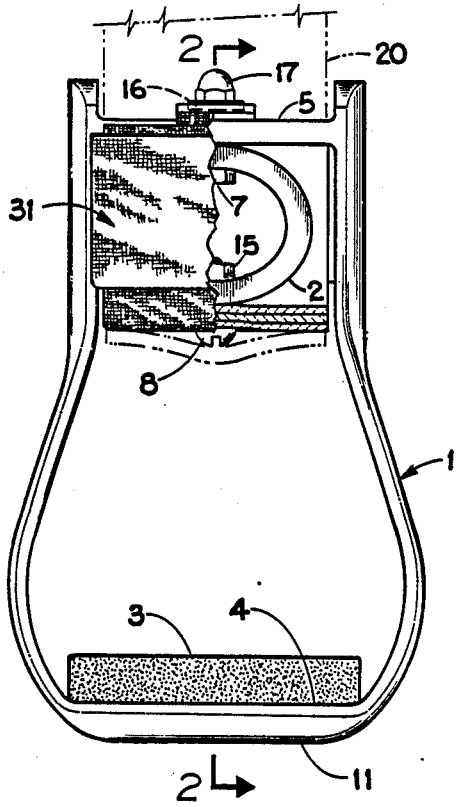
FIG. 1 is a front elevational view partially broken away of a stirrup made according to my invention.
Figure 2:
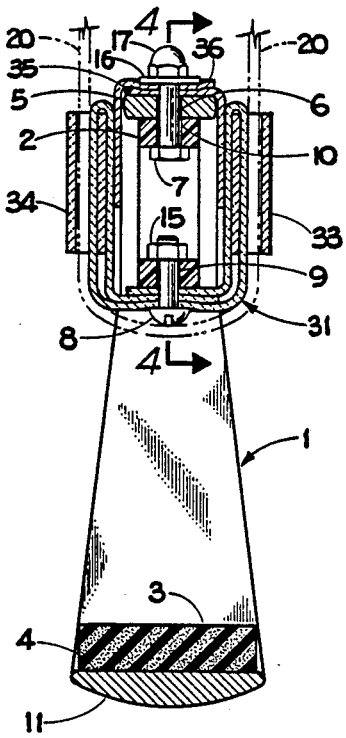
FIG. 2 is a sectional view thereof taken along the line 2—2 in FIG. 1.
Figure 3:
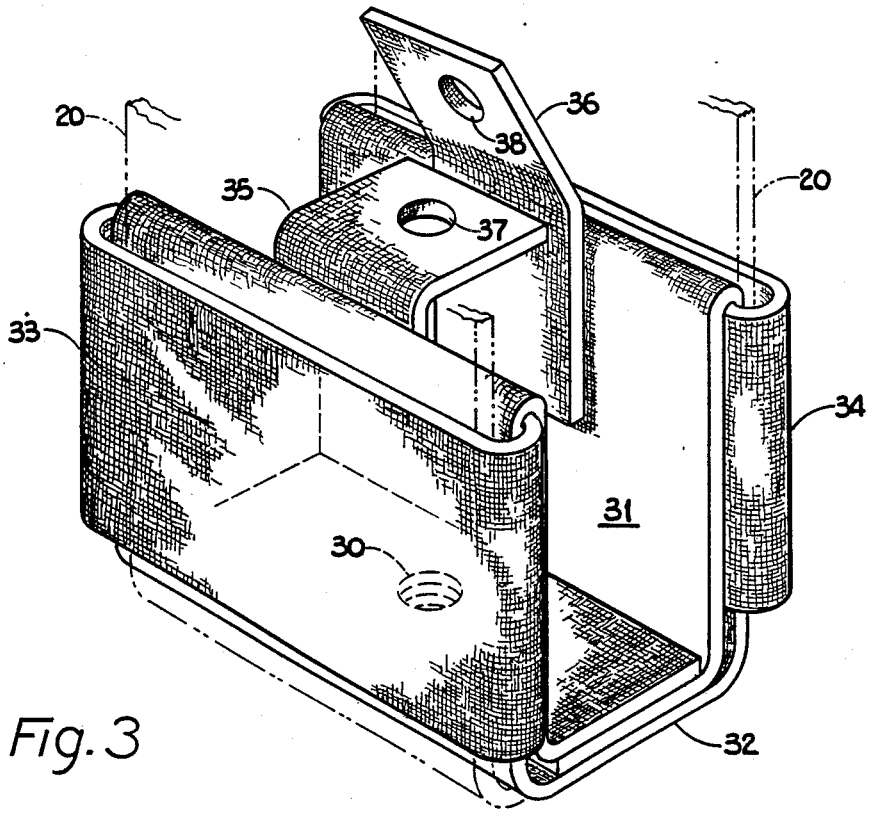
FIG. 3 is a perspective view of the saddle leather keeper, which saddle leathers slip through to hold the stirrup in place.

In the practice of my invention referring to FIGS. 1 and 2 I provide a stirrup composed of a single piece of sand casted aluminum frame 1, having a bottom 11, sides 22, and a support bar 5, which has a 5/16" hole 6 casted, being $1\frac{1}{2}\times\frac{5}{8}$" to center. A Polyester elastomer, 2, named TECS PAK, which is a proprietary elastomer based on DUPONT HYTREL, HYTREL being a registered trademark for its polyester elastomer, but this elastomer not being of such that a different elastomer or brand name of elastomer could be employed for the purpose of providing a shock absorbing device. The polyester elastomer 2 I employ, being egg shaped with a width of $\frac{3}{4}$" and $2\frac{1}{2}$" in length at its widest point and a height of $1\frac{1}{4}$" at its highest point and a thickness of $\frac{1}{4}$" and having a 5/16" hole 10 drilled in the top, to center and a 5/16" hole 9 drilled in the bottom of the elastomer 2 to center. The purpose of the bottom hole is to secure the elastomer 2 to the keeper 31 (as seen in FIG. 3), which is comprised of a flat tripled layer of polypropylene belting strap sewn by machine together on the edges to form a single piece 31 3" in width and $6\frac{3}{4}$" in length, attached to the top of each of the outside edges of the keeper 31 is a 2" in width and 4" in length nylon belting with the first $\frac{1}{2}$" on each end of the nylon belting being folded back to the insides 39 of the keeper 31 and sewn by machine to inside of the keeper forming a loop on each side called keeper loops 33 and 34. The keeper 31 has two anchor straps, 35 and 36, one on each side of the inside of the keeper 31 which are 1" in width and 2" in length nylon belting, with the first 1" in length being sewn by machine to the inside of the keeper 31 leaving 1" being left to extend past the end of the keeper 31 1", with holes 37, 38 in each 5/16" which is placed $\frac{1}{2}''\times\frac{1}{2}''$ to center. In the center or bottom inside of keeper 31 there is a keeper hole 30 (5/16") which is placed $1\frac{1}{2}$" to $3\frac{3}{8}$" to center. Using a $\frac{1}{4}''\times\frac{1}{2}''$ round stove bolt 8 the bolt is placed through the bottom of the keeper hole 30 upward thru the bottom hole 9 in the elastomer and secured parallel to the keeper 31 using a $\frac{1}{4}'$ hex head nut 15. The keeper 31 and the elastomer 2 are then fastened to the support bar 5 by using a $\frac{1}{4}'\times 1'$ hex head bolt 7 which is placed inside the elastomer 2 pushed upward through the top hole in the elastomer 10 and continuing up through the bottom of the support bar hole 6. The anchor strap 35 is then folded over the top of the support bar 5. The anchor strap 36 is then folded over the top of anchor strap 35 aligning the anchor strap holes 37 38 in each anchor strap the $\frac{1}{4}'\times 1'$ hex head bolt 7 is then pushed upward through the anchor strap holes 37 and 38 extending through the top of the support bar 5 and above top anchor strap $\frac{1}{4}'$, 36 which is then fitted with $\frac{1}{4}'$ washer 16 with acorn nut 17. This assembles the elastomer 2 to the keeper, 31 and the keeper 31 to the support bar 5 of the Aluminum Frame 1.

I have attached to bottom tread 4, of the aluminum frame 1 a $4'\times 2\frac{1}{4}'\times\frac{5}{8}$ thick closed cell rubber pad, 3. This is bonded to the bottom tread with KirkHill Metal to Rubber Contact Cement. The purpose of the rubber pad is to add a comfort cushion for the feet of the rider and is not shock absorbing device.

The stirrups are attached to the saddle by assembling saddle leather or saddle stirrup strap which are not a part of this design, and attached to the saddle, having a buckle or latch to allow you to separate the saddle leather by creating an opening in the saddle leather so the stirrup can be attached and then resecured.

The shock absorbing stirrup is attached to the saddle by looping the saddle leather, downward and through the top of the keeper loop 33, across the bottom of Keeper 32, and up the through the bottom of the keeper loop 34. The saddle leathers continue up meeting the other end of the saddle leather, connecting the saddle leather which is buckled or latched completing the connection.

The assembling of the polyester elastomer 2 to the keeper 31 and attaching and securing this assembly to the support bar 5 of the aluminum frame 1 qualifies my invention to be a shock absorbing stirrup.

To qualify to be a shock absorbing device you must be able to absorb or dispel the energy or force. This is done by creating a friction, or slowing of the force, creating heat, with heat dispelling the energy force. The absorbing device must be able to then spring back or return to its original shape or position enabling it to prepare to meet and dispel the next force.

Figure 4:
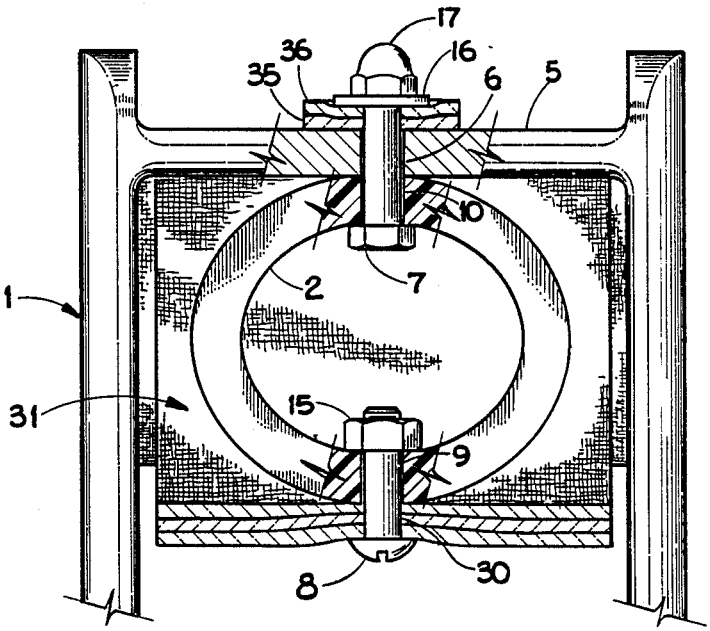
FIG. 4 is a fragmentary sectional view taken along the line 4—4 in FIG. 2.

I am able to do this with my invention by using the polyester elastomer shown in FIG. 4. This elastomer has a maximum deflection of 200 pounds per inch and creates a friction which creates heat to dispel the energy.

A rider after mounting the saddle places both feet in the shock absorbing stirrups which create a pressure on the bottom tread forcing the elastomer to contract enough to pick up and support the force the rider is applying. As the horse moves, more force is created, the amount of force depending on the speed and movement of the horse. The polyester elastomer will create the needed shock absorption that will make for a smoother and more comfortable ride for both horse and rider.

It will further be apparent that the precise configuration of my invention may vary from specific design applications.

I claim:

1. A shock absorbing stirrup for an equestrian saddle comprising a stirrup frame having a substantially horizontal tread portion, two upright side portions joined at their bottoms to the ends of said tread portion and an elongated support bar extending between and joined to said side portions near the top thereof, a shock absorbing device approximately two inches high formed of a ring of elastomeric energy absorbing material and having a vertical deflection-force characteristic of at least about 200 pounds per inch, means for rigidly securing said shock absorbing device on the bottom of said support bar between said side portions, and a keeper having at least one loop element positioned to receive a saddle stirrup strap passing down from a saddle through said at least one loop element under said shock absorbing device and back up toward said saddle.

2. Apparatus as recited in claim 1 wherein said at least one loop element is formed of nylon belting and has a horizontal dimension of about three inches measured parallel to said support bar.

3. Apparatus as recited in claim 1 wherein said shock absorbing device is formed of a ring of polyester elastomer having a hole in the top of the ring and is secured by a bolt to said support bar.

4. A shock absorbing stirrup comprising a stirrup frame having substantially horizontal tread portion, two upright side portions joined at their bottoms to the ends of said tread portion and an elongated support bar extending between and joined to said side portions near the top thereof, a shock absorbing device formed of elastomeric energy absorbing material and having a vertical deflection-force characteristic of at least about 200 pounds per inch, means for rigidly securing said shock absorbing device on the bottom of said support bar between said side portions, at least one belting loop secured to said stirrup frame and positioned to receive a saddle stirrup strap passing down from a saddle through said at least one loop and under said shock absorbing device and back up toward said saddle.

5. Apparatus as recited in claim 4 further including a closed cell rubber pad bonded to the top of said tread portion.

6. Apparatus as recited in claim 4 wherein said at least one belting loop has a horizontal dimension of about three inches measured parallel to said support bar.

7. Apparatus as recited in claim 4 wherein said shock absorbing device is formed of a ring of polyester elastomer having a hole in the top of the ring and secured by a bolt to said support bar.

8. A shock absorbing stirrup comprising a stirrup frame having a substantially horizontal tread portion, two upright spaced-apart side portions joined at their bottoms to the respective ends of said tread portion and a support bar extending between and fixedly joined to said side portions near the top thereof, a shock absorbing device approximately two inches high and two inches wide formed of a ring of polyester elastomeric energy absorbing material and having a vertical compression-force characteristic of about 200 pounds per inch, means for rigidly securing said shock absorbing device on the bottom of said support bar including a fastener member secured through holes in said shock absorbing device and said support bar, a keeper formed by a belting strap secured on the bottom of said shock absorbing device and extending upward along the sides thereof and a pair of belting loops secured to said strap and positioned to receive a saddle stirrup strap passing down from a saddle through one of said loops under said shock absorbing device and back up through the other of said loops, and an anchor strap attached to the top of at least one of said belting straps and secured on the top of said support bar by said fastener member.

9. Apparatus as recited in claim 8 further including a closed cell rubber pad bonded to the top of said tread portion.

* * * * *